US007705224B1

(12) United States Patent
Ward

(10) Patent No.: US 7,705,224 B1
(45) Date of Patent: Apr. 27, 2010

(54) PORTABLE TRAVEL GUITAR

(76) Inventor: John Ward, 2420 Orange Ave., Costa Mesa, CA (US) 92627

( * ) Notice: Subject to any disclaimer, the term of this patent is extended or adjusted under 35 U.S.C. 154(b) by 0 days.

(21) Appl. No.: 12/540,603

(22) Filed: Aug. 13, 2009

(51) Int. Cl.
*G10D 1/08* (2006.01)

(52) U.S. Cl. ..... 84/267; 84/291

(58) Field of Classification Search ..... 84/267, 84/290, 291, 293
See application file for complete search history.

(56) References Cited

U.S. PATENT DOCUMENTS

| | | | | |
|---|---|---|---|---|
| 2,464,100 | A | 3/1949 | Ruggiero | |
| 4,191,085 | A | 3/1980 | Litwin | |
| 4,573,391 | A | 3/1986 | White | |
| 4,686,882 | A | 8/1987 | Shaw | |
| 5,058,479 | A | 10/1991 | Shaw | |
| 5,353,672 | A | 10/1994 | Stewart | |
| 5,383,385 | A | 1/1995 | Gilbert | |
| 5,390,578 | A | 2/1995 | Raymer | |
| 6,025,548 | A | 2/2000 | Erlich | |
| D516,114 | S | 2/2006 | Leach | |
| 2007/0289427 | A1 * | 12/2007 | Liang | 84/291 |

* cited by examiner

*Primary Examiner*—Kimberly R Lockett
(74) *Attorney, Agent, or Firm*—Vladimir Khiterer

(57) ABSTRACT

A portable travel guitar comprises a removable neck and a tapered removable panel attached to an opening in the body of the guitar by an airtight joint. Pre-tensioned strings attached to the removable panel bias it towards the closed position. Items can be stored inside the body of the guitar for ease of storage inside luggage. An auxiliary panel is provided permitting using the body of the guitar as separate luggage.

5 Claims, 4 Drawing Sheets

PORTABLE TRAVEL GUITAR

FIELD OF THE INVENTION

The present invention relates to a portable travel guitar that utilizes the volume inside the guitar body for storage of items.

BACKGROUND OF THE INVENTION

Limitations on the size and number of carry-on luggage, as well as security requirements, make air travel by commercial aircraft while carrying a full size acoustic guitar difficult. There are numerous designs for a portable guitar. To one extent or another, these designs involve collapsing and nesting various components of the guitar to allow packing into a luggage suitable to carry onboard an aircraft. However, all such designs require complicated re-assembly and re-tuning. More importantly, such designs have inferior sound quality compared to a conventional (i.e. non-portable) acoustic guitar.

A conventional acoustic guitar produces sound by way of the strings vibrating and transmitting their vibrations to the body of the guitar. The body amplifies the sound and the sound comes out of the sound hole. The back, top, and sides of the instrument are carefully constructed and braced to accept the considerable string tension, and yet still produce pleasing music and tone. Structural integrity is of utmost importance for the sound quality, yet it is extremely difficult to achieve with collapsible and nesting designs. Additional structural elements, such as extra bracing and connections between parts, which are not present in a conventional acoustic guitar, cause further deterioration of the sound quality.

The collapsible and nesting designs also suffer air leakage between various parts, which is not present in a conventional acoustic guitar, where air can only escape through the sound hole. Air leakage causes additional deterioration of the sound quality.

Simply put, a portable acoustic guitar should be, ideally, as close in its structural integrity to and differ as little as possible from a conventional acoustic guitar.

Finally, the prior art does not utilize the volume inside the guitar body for storage of items, other than parts of the guitar, while traveling. This unutilized real estate can be used for storage and make travel via a commercial aircraft less difficult.

Accordingly, there is a need for a portable travel guitar that overcomes the limitations of the prior art.

SUMMARY OF THE INVENTION

The portable travel guitar according to this invention overcomes the disadvantages of the prior art. It comprises a removable panel that slides inside the body, forming an airtight connection, and a removable neck. Volume inside the body can be used for storage of items. In one embodiment, the body of the guitar itself can be used as luggage.

DETAILED DESCRIPTION

Figure 1:
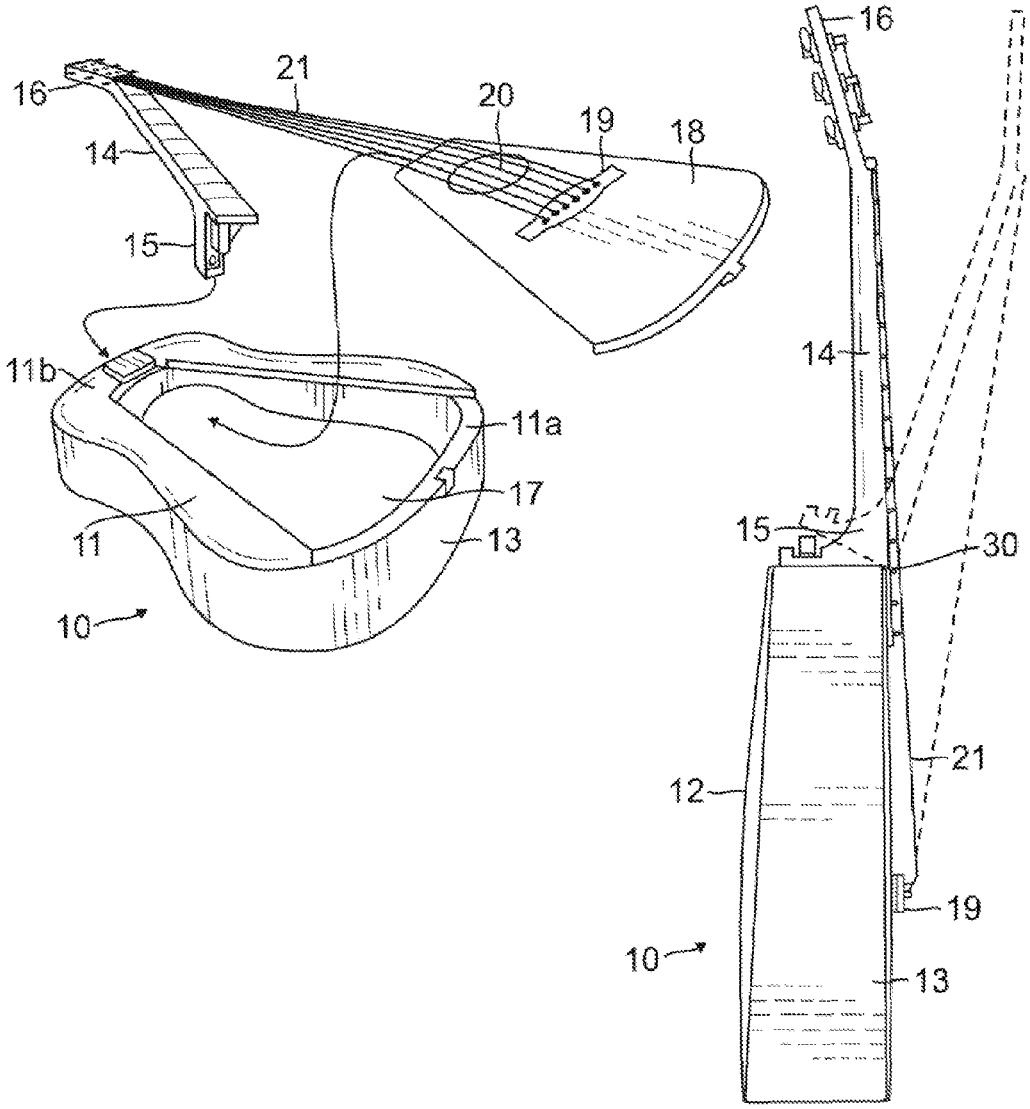
FIG. 1 shows a perspective view of the portable travel guitar according to this invention in the disassembled condition, as well as a side elevational view thereof in the assembled condition.

This invention will be better understood with the reference to the drawing figures FIG. 1 through FIG. 4. The same numerals refer to the same elements in all drawing figures.

Viewing now FIG. 1, numeral 10 indicates a body. Body 10 is hollow and is guitar-shaped. Body 10 is formed by a face wall indicated by numeral 11, a back wall indicated by numeral 12 and a side wall indicated by numeral 13. Side wall 13 surrounds face wall 11 and back wall 12. Face wall 11 comprises a proximate end indicated by numeral 11*a* and a distal end indicated by numeral 11*b*. Body 10 defines a cavity having volume for storing items inside. Storing items inside body 10 allows a traveler to free space inside luggage and store the guitar according to this invention inside the luggage. Specifically, if the volume inside body 10 is utilized for storage, the guitar according to this invention displaces very little of the volume inside the luggage, thus avoiding the need for extra luggage pieces to carry the guitar. If a traveler needs only one piece of luggage for her clothes, she would still need only one piece to carry both the clothes and the guitar.

Numeral 14 indicates a neck. Neck 14 is removably attached to distal end 11*b*. Neck 14 extends outwardly from a heel indicated by numeral 15 and terminates in a headstock indicated by numeral 16. In the preferred embodiment described with the reference to FIG. 1, a fingerboard is disposed along neck 14 with a portion of the fingerboard disposed on body 10.

Numeral 17 indicates an opening. Opening 17 is disposed on face wall 11 and extends from proximal end 11*b* about the longitudinal axis of face wall 11. Opening 17 terminates a predetermined distance from distal end 11*b*. In the preferred embodiment described with the reference to FIG. 1, the predetermined distance is shown as approximately 2.5 inches, which is to the length of the portion of the fingerboard disposed on body 10.

Opening 17 tapers, in a symmetrical fashion, in a direction of distal end 11*b*. The tapered shape of opening 17 provides for high structural integrity of body 10, a very important factor affecting sound quality of the guitar. In fact, despite having opening 17, the guitar according to this invention requires no additional bracing inside body 10, other than the bracing found inside a body of a conventional acoustic guitar. A tapered shape of opening 17 also provides for easy installation of a removable panel indicated by numeral 18. Opening 17 receives removable panel 18, which is shaped as opening 17. Removable panel 18 easily slides inside opening 17.

Numeral 19 indicates a bridge and numeral 20 indicates a sound hole. Both bridge 19 and sound hole 20 are disposed on removable panel 18.

Numeral 21 indicates a plurality of strings. The preferred embodiment described in FIG. 1 shows six strings 21. Each string 21 has one end connected to headstock 16. The other ends of strings 21 are connected to bridge 19. Strings 21 are pre-tensioned. They bias removable panel 18 in the direction of distal end 11*b*, thereby forming a substantially airtight connection between opening 17 and removable panel 18. Avoiding air leakage between opening 17 and removable panel 18 and permitting air to escape only through sound hole 20 is critical for the sound quality of the guitar according to this invention. Further, pre-tensioned strings 21, by biasing removable panel 18 in the "closed" position serve as a structural element necessary for the structural integrity of the guitar, in addition to the tapered shape of opening 17 and removable panel 18.

Dashed lines on the right side of FIG. 1 show neck 14 pivoted out and strings 21 in a slack position for disassembly by way of sliding removable panel 18 out of opening 17.

Figure 2:
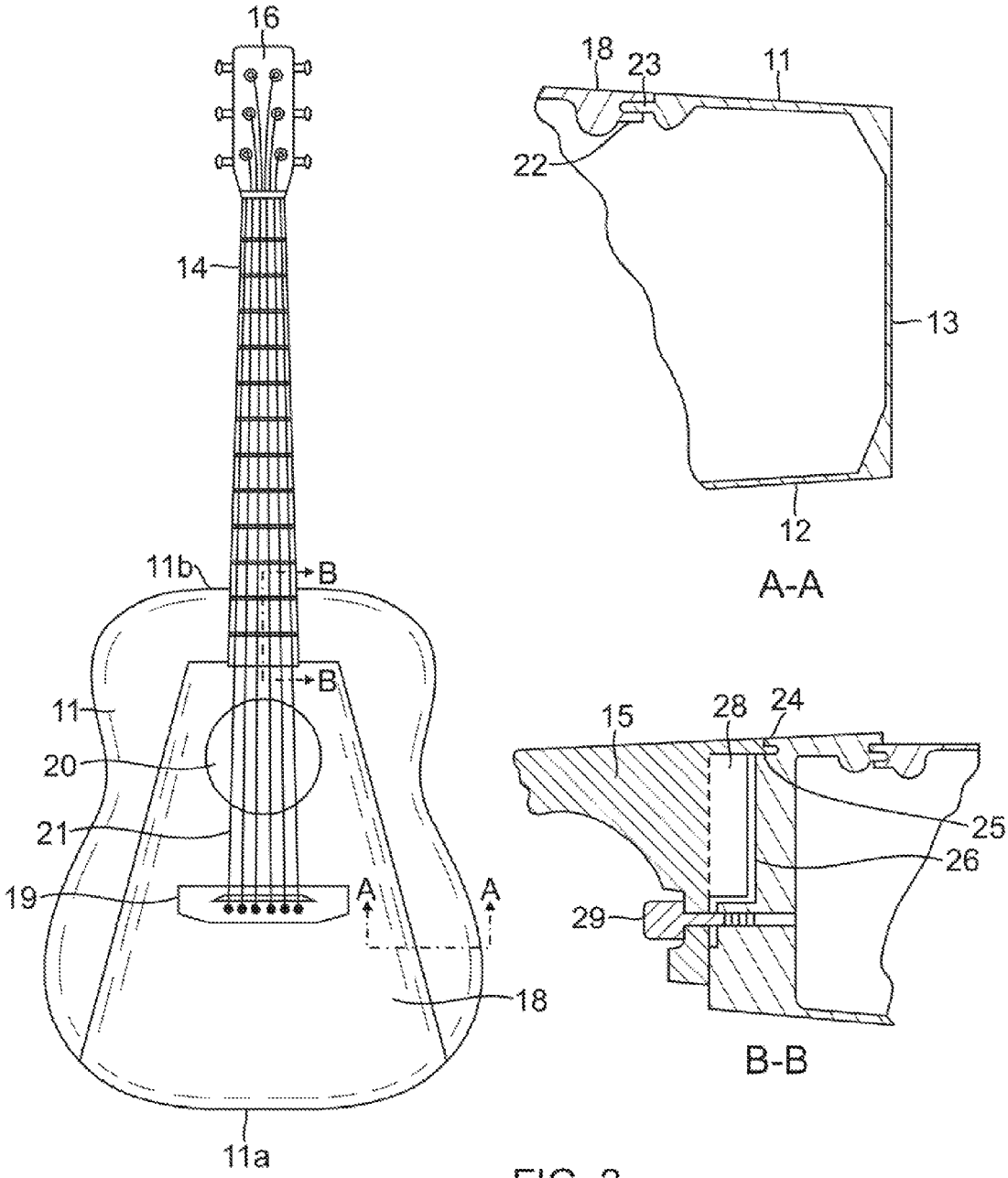
FIG. 2 is a front plan view thereof, as well as the cross sectional views of various portions thereof.

In the preferred embodiment shown in FIG. 2, the airtight connection between opening 17 and removable panel 18 comprises a first mortise indicated by numeral 22 and a first tennon indicated by numeral 23. First mortise 22 and first tennon 23 are shown in the cross section A-A in FIG. 2. First mortise 22 is disposed along sides of removable panel 18. First tennon 23 is disposed along sides of opening 17. First mortise 22 and first tennon 23 fit snugly into one another. Accordingly, sliding removable panel 18 inside opening 17 creates a substantially airtight mortise and tennon joint between them.

Figure 3:
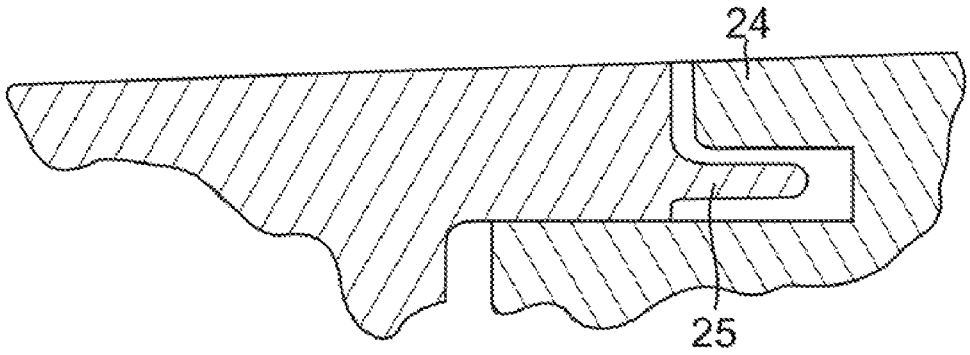
FIG. 3 shows perspective and cross sectional views of the connection between a neck and a body of the guitar according to this invention.
Figure 3:
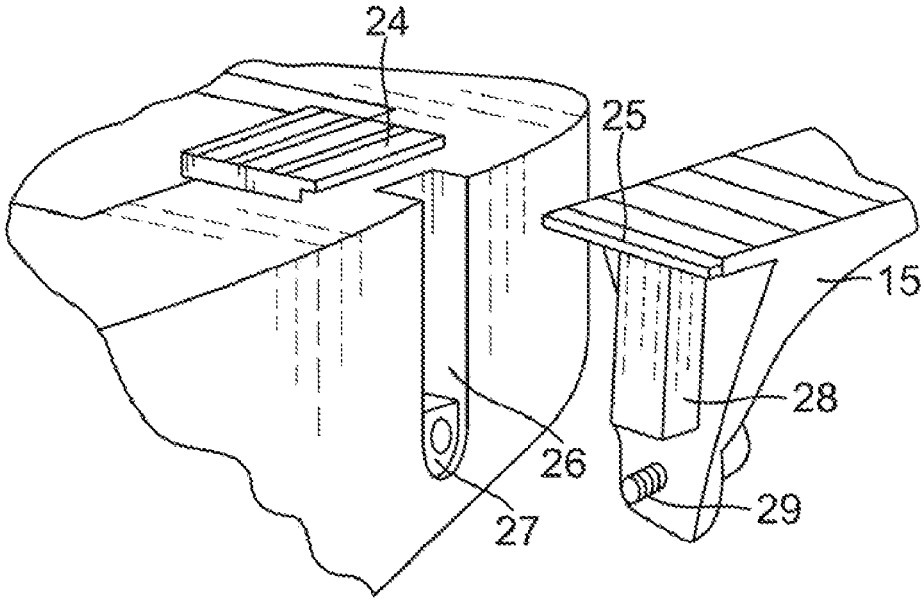

Still viewing FIG. 2, cross section B-B, together with FIG. 3, connection of neck 14 to body 10, according to the preferred embodiment of this invention is explained.

Numeral 24 indicates a first lip. First lip 24 is disposed on distal end lib. Numeral 25 indicates a second lip. Second lip 25 is disposed on heel 15.

Numeral 26 indicates a second mortise. Second mortise 26 is disposed on side wall 13 adjacent to distal end 11*b*. Second mortise 26 comprises a nut indicated by numeral 27.

Numeral 28 indicates a second tennon. Numeral 29 indicates a thumb screw. Second tennon 28 and thumb screw 29 are disposed on heel 15.

To connect neck 14 to body 10, second lip 25 pivotally and slidably engages with first lip 24, while second mortise 26 receives second tennon 28 and nut 27 receives and threadably engages thumb screw 29.

In the preferred embodiment described herein, first lip 24 and second lip 25 form a pivot point indicated by numeral 30 (shown in FIG. 1). Pivot point 30 is located substantially near a line of action (that is a vector of the biasing force) of strings 21. In the preferred embodiment described with the reference to FIG. 1, the distance between pivot point 30 and strings 21 is approximately 4 mm (0.16 inches). As such, very little effort is required in order to connect neck 14 to body 10. In essence, in order to re-assemble the guitar according to this invention from the travel configuration to the play configuration, the user would first remove the items stored inside body 10, slide removable panel 18 from the rear of body 10 while engaging first mortise 22 and first tennon 23, position neck 14 such that strings 21 are in a slack position, as shown by the dashed lines in FIG. 1, engaging second mortise 26 with second tennon 28, apply force to neck 14 and pivot neck 14 about pivot point 30 into position and then tighten thumb screw 29. Very little re-tuning, if any, is required, the instrument is ready to play.

Figure 4:
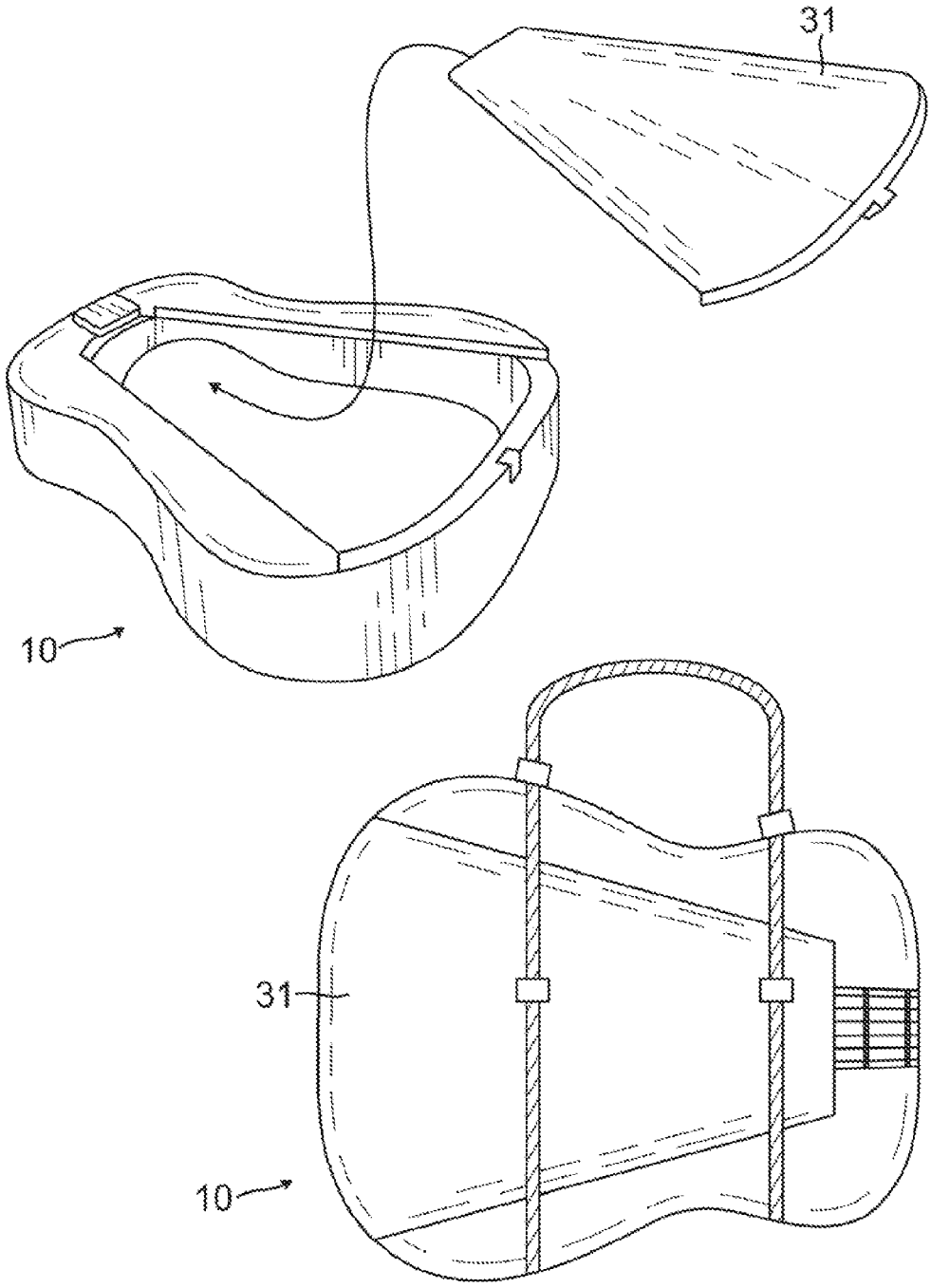
FIG. 4 shows a perspective and a front plan view thereof showing an additional, feature according to the preferred embodiment of this invention.

An alternative embodiment is shown in FIG. 4. Numeral 31 indicates an auxiliary panel. Auxiliary panel 31 is shaped like removable panel 18, but unlike removable panel 18, lacks bridge 19 and sound hole 20.

Body 10 with auxiliary panel 31 attached to opening 17 is adapted for use as luggage. Items can be stored inside body 10 and enclosed by auxiliary panel 31. Body 10 can be carried under arm to transport the items, or a belt or other means can be attached to body 10 for ease of carrying, as shown in FIG. 4. In practice, removable panel 18 and neck 14 attached thereto through strings 21 would be carried in a separate pouch.

While the present invention has been described and defined by reference to the preferred embodiment of the invention, such reference does not imply a limitation on the invention, and no such limitation is to be inferred. The invention is capable of considerable modification, alteration, and equivalents in form and function, as will occur to those ordinarily skilled and knowledgeable in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

I claim:

1. A portable travel guitar comprising:

a hollow guitar-shaped body formed by a face wall, a back wall and a side wall surrounding the face and back walls, the face wall comprising a proximate end and a distal end, the body defining a cavity having volume for storing items therein;

a neck removably attached to the distal end, the neck extending outwardly from a heel and terminating in a headstock;

an opening disposed on the face wall extending from the proximal end about the longitudinal axis of the face wall and terminating a predetermined distance from the distal end, the opening symmetrically tapering in a direction of the distal end, the opening receiving a removable panel shaped as the opening;

a bridge and a sound hole disposed on the removable panel;

a plurality of pre-tensioned strings each having one end thereof connected to the headstock, the other ends of the strings being connected to the bridge, wherein the strings biasing the removable panel in the direction of the distal end, thereby forming a substantially airtight connection between the opening and the removable panel.

2. A portable travel guitar as in claim 1, wherein the airtight connection further comprising a first mortise disposed along sides of the removable panel and a first tennon disposed along sides of the opening.

3. A portable travel guitar as in claim 2, further comprising:

a first lip disposed on the distal end;

a second lip disposed on the heel, the second lip pivotally and slidably engaging with the first lip;

a second mortise disposed on the side wall adjacent to the distal end, the second mortise comprising a nut;

a second tennon disposed on the heel;

a thumb screw disposed on the heel;

wherein the second mortise receiving the second tennon and the nut receiving and threadably engaging the thumb screw.

4. A portable travel guitar as in claim 3, wherein the first lip and the second lip forming a pivot point located substantially near a line of action of the strings.

5. A portable travel guitar as in claim 4 further comprising an auxiliary panel shaped as the removable panel and lacking the bridge and the sound hole, the hollow guitar-shaped body with the auxiliary panel attached to the opening adapted for use as a luggage.

* * * * *